US006604575B1

(12) United States Patent
Degtiarenko

(10) Patent No.: US 6,604,575 B1
(45) Date of Patent: Aug. 12, 2003

(54) HEAT EXCHANGE APPARATUS

(75) Inventor: Pavel V. Degtiarenko, Williamsburg, VA (US)

(73) Assignee: Southeastern Univer. Research Assn. Inc., Newport News, VA (US)

( * ) Notice: Subject to any disclaimer, the term of this patent is extended or adjusted under 35 U.S.C. 154(b) by 0 days.

(21) Appl. No.: 10/231,582

(22) Filed: Aug. 30, 2002

(51) Int. Cl.[7] ..... F28F 7/00

(52) U.S. Cl. ..... 165/185; 165/80.3; 361/697

(58) Field of Search ..... 165/80.3, 83, 84, 165/86, 89, 185; 361/697, 703, 710

(56) References Cited

U.S. PATENT DOCUMENTS 3,081,824 A * 3/1963 MaCall ..... 165/185
3,312,277 A * 4/1967 Chitouras et al. ..... 165/185
4,535,841 A * 8/1985 Kok ..... 165/185
4,770,242 A * 9/1988 Daikoku et al. ..... 165/185
4,800,956 A * 1/1989 Hamburgen ..... 165/185
5,042,257 A * 8/1991 Kenrick et al. ..... 62/3.1
5,456,081 A * 10/1995 Chrysler et al. ..... 165/185
5,682,948 A * 11/1997 Bock ..... 165/185
5,787,976 A * 8/1998 Hamburgen et al. ..... 165/185
5,829,514 A * 11/1998 Smith et al. ..... 165/80.3
6,009,938 A * 1/2000 Smith et al. ..... 165/185
6,279,648 B1 * 8/2001 Diels et al. ..... 165/80.3
6,396,693 B1 * 5/2002 Shih ..... 361/703

* cited by examiner

*Primary Examiner*—Henry Bennett
*Assistant Examiner*—Temell McKinnon

(57) ABSTRACT

A heat exchange apparatus comprising a coolant conduit or heat sink having attached to its surface a first radial array of spaced-apart parallel plate fins or needles and a second radial array of spaced-apart parallel plate fins or needles thermally coupled to a body to be cooled and meshed with, but not contacting the first radial array of spaced-apart parallel plate fins or needles.

3 Claims, 2 Drawing Sheets

HEAT EXCHANGE APPARATUS

The United States of America may have certain rights to this invention under Management and Operating contract No. DE-AC05-84ER 40150 from the Department of Energy.

FIELD OF THE INVENTION

The present invention relates to heat exchange apparatus and more particularly to heat exchange apparatus useful for the cooling or heating of two bodies that are moving with respect to each other.

BACKGROUND OF THE INVENTION

The cooling of equipment wherein the parts to be cooled are: 1) moving linearly or rotationally with respect to a heat absorption system; 2) not amenable (difficult or impossible) to direct contact with a heat collector or coolant: or 3) immersed in a vacuum poses difficult and unique heat exchange problems. In such cases, it is difficult to place heat conducting substances between a part to be cooled and a heat collector.

Thermal radiation cooling is widely used in many such applications, sometimes in combination with convective cooling, in the form of heat dissipation, i.e. heat transfer from the hot portion(s) to the surrounding environment. Since the heat flux in a cooling system is directly proportional to the surface area of the hot portion facing the cold environment, the dissipation of large heat fluxes requires very large surface areas and is, in many cases, impractical. This is especially true in applications where space is at a premium and relatively large convective heat exchange systems cannot be used.

Thus, there exists a need for heat transfer apparatus that is capable of achieving adequate heat transfer in such applications, especially in those cases where space constraints dictate that the heat exchange apparatus be as compact as possible.

OBJECTS OF THE INVENTION

It is therefore an object of the present invention to provide a heat exchange apparatus that is capable of achieving high heat fluxes in designs wherein: the parts to be cooled are moving linearly or rotationally with respect to each other; direct contact between parts(s) to be cooled and a heat collector or coolant is undesirable or impossible; or the part to be cooled is immersed in a vacuum.

It is another object of the present invention to provide a heat exchange apparatus that is capable of achieving high heat fluxes in the just recited situations in a compact configuration.

SUMMARY OF THE INVENTION

According to the present invention, there is provided a heat exchange apparatus comprising a coolant conduit or heat sink having attached to its surface a first radial array of spaced-apart parallel plate fins or needles and a second radial array of spaced-apart parallel plate fins or needles thermally coupled to a body to be cooled and meshed with, but not contacting the first radial array of spaced-apart parallel plate fins or needles.

DETAILED DESCRIPTION

The apparatus described herein utilizes thermal radiation as the principal carrier of heat from the hot parts to the heat absorber. The main advantage of this method as compared to radiative heat dissipation is that it provides a larger heat flux in a more compact design and transfers heat to a dedicated heat absorber without irradiating the environment. In the apparatus described in greater detail herein, a part to be cooled is attached to a thermoconductive heat sink with a set of thin plates or needles that are inserted between similar plates or needles attached to a heat collector. This design provides complete isolation between the hot and the cold parts of the apparatus and can be used to cool parts that are moving linearly or rotationally with respect to one another or are located in a vacuum.

Figure 1:
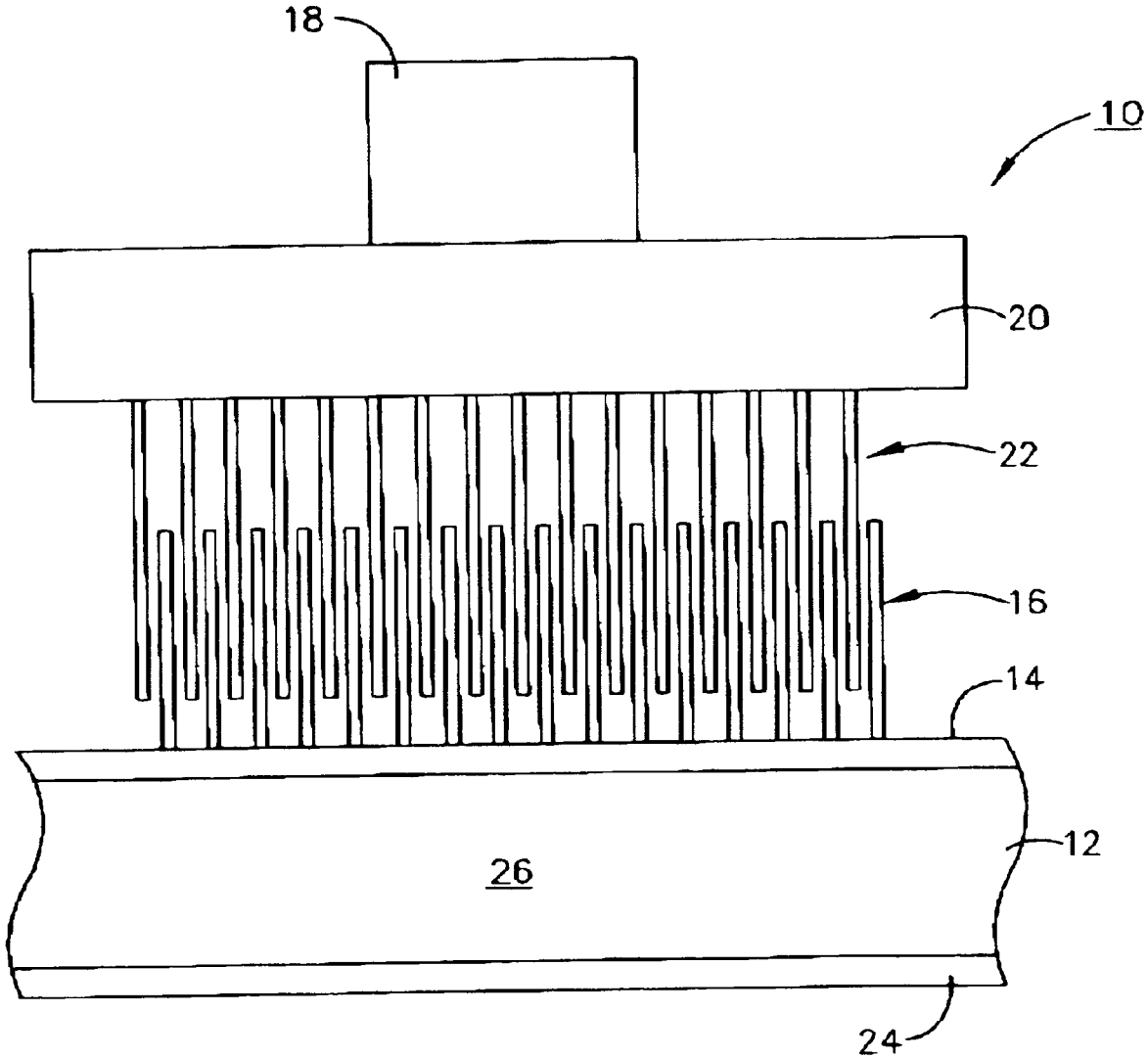
FIG. 1 is a cross-sectional view of one embodiment of the heat exchange apparatus of the present invention.

Referring now to FIG. 1, heat exchange apparatus 10 of the present invention comprises a coolant conduit or heat sink 12 having attached to its outer surface 14 a first radial array of spaced-apart parallel plate fins or needles 16. A part or member, hereinafter "a body" 18 that needs to be cooled is thermally coupled to a retaining member 20 having a second radial array of spaced-apart parallel plate fins or needles 22 extending therefrom in the direction of and meshed with, but not contacting first radial array of spaced-apart parallel plate fins or needles 16. Alternatively, second radial array of spaced-apart parallel plate fins or needles 22 could be attached to body 18 thereby obviating the need for retainer 20. As long as body 18 is thermally coupled to second radial array of spaced-apart parallel plate fins or needles 22, the heat exchange apparatus will be operative. Heat exchange between part 18 and heat sink 12 occurs in this embodiment by conduction through retainer 20, if included, to second radial array of spaced-apart parallel plate fins or needles 22, thence by radiation to first radial array of spaced-apart parallel plate fins or needles 16, by conduction through wall 24 of coolant conduit 12 to a coolant 26 flowing inside of coolant conduit or heat sink 12.

Quite clearly a number of modifications to this structure can be readily envisioned. For example, heat sink 12 while depicted in FIG. 1 as a coolant conduit because of the relatively high cooling efficiencies that can be achieved with such systems could also comprise a third radial array of spaced-apart parallel plate fins or needles that dissipate heat or thermal energy transmitted through first radial array of spaced-apart parallel plate fins or needles 16 through some intermediate structure that serves to retain both the first radial array of spaced-apart parallel plate fins or needles 16 and a third radials array of parallel plate fins or needles (not shown) that replace heat sink 12 as depicted in FIG. 1. In essence, once heat has been transferred from body 18 through second and first radial arrays of parallel plate fins or needles 22 and 16, any other suitable and adequate heat exchange method and apparatus can be used to remove heat from the system in lieu of heat sink 12 as depicted in FIG. 1.

In the embodiment depicted in FIG. 1, body 18, thermally coupled retainer 20, if included, and second radial array of spaced-apart parallel plate fins or needles 22 can move linearly, i.e. reciprocate with respect to first radial array of spaced-apart parallel plate fins or needles 16, if this is an appropriate arrangement, and entire heat exchange apparatus 10 could be contained in a vacuum. Alternatively, if adequate surface area is incorporated into first and second radial arrays of parallel plate fins or needles 16 and 22, both body 18 and heat sink 12 could be stationary with heat transfer by conduction and radiation taking place as described herein above.

Figure 2:
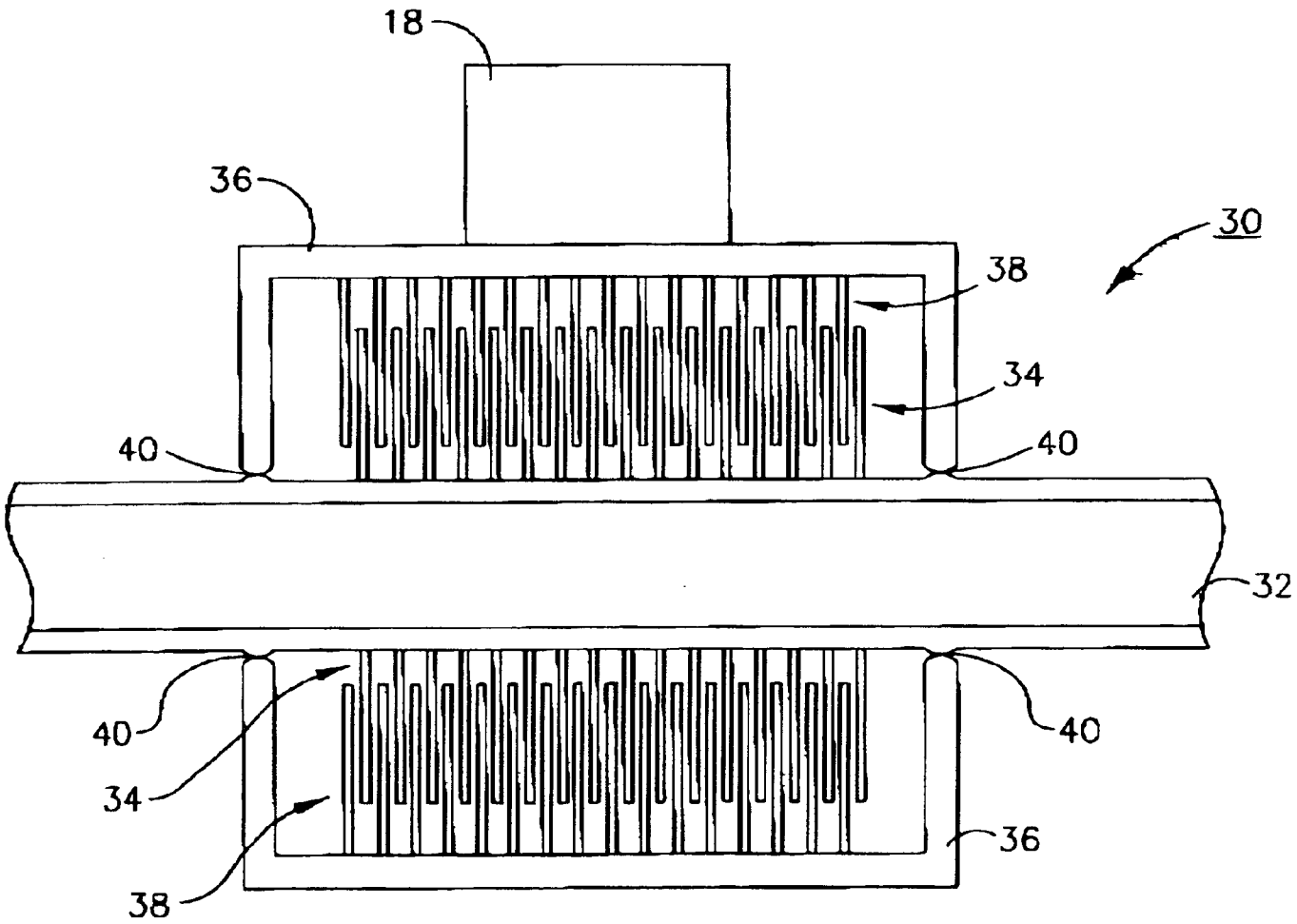
FIG. 2 is a cross-sectional view of an alternative preferred embodiment of the heat exchange apparatus of the present invention.

Referring now to FIG. 2 that depicts an alternative embodiment of the heat exchange apparatus of the present invention that permits heat extraction from body 18 using a rotating arrangement, heat exchange apparatus 30 comprises a central heat sink or coolant conduit 32 having a first radial array of spaced-apart parallel plate fins or needles 34 extending outwardly therefrom. Body 18 is supported on a bridge structure 36 having a second radial array of spaced-apart parallel plated fins or needles 38 extending inwardly therefrom and meshing, but not contacting, first radial array of spaced-apart parallel plate fins or needles 34. Elements 34 and 38 are, of course in close physical proximity but not touching at any point. Bridge 36 and associated body 18 and second radial array of spaced-apart parallel plate fins or needles 38 rotates about heat sink or coolant conduit 32 on bearings 40 and is driven by an appropriate drive mechanism (not shown). In this configuration, body 18 can be cylindrical in shape or be of another shape, for example elongated, but thermally coupled to bridge 36 by attachment thereto or otherwise. Again, entire heat exchange apparatus 30 could be contained in a vacuum, if appropriate to the particular design. Such an arrangement would be suitable, for example, in the case where body 18 was a flat ring target being exposed to an incoming electron or other suitable beam.

As will be known to the skilled artisan, radiational heat exchange from hot parallel plate fins or needles 38 to cold parallel plate fins needles 30 is defined as a heat flux $H=F_{rad}Sc(T^4_{hot}-T^4_{cold})$ where $F_{rad}$ is a coefficient dependent upon the parallel plate surface properties, S is radiating area; $c=5.7\ 10^{-12}\ W\ cm^{-2}K^{-4}$, the Stefan-Boltzman constant and T is temperature in degrees Kelvin. If $T_{cold}$ is neglected and assume for a simple exercise the equilibrium temperature of the heat sink to be 1000° K., outer radius of a coolant pipe 2 cm, the inner radius of the heat sink 10 cm and $F_{rad}$ conservatively as 0.3 the heat flux exiting one single hot fin equals approximately $0.3\times600\times5.7\times10^{-12}\times1000^4$ which is about 1 kW, if one assumes that the heat flux at this rate can be absorbed by the coolant. More detailed calculations are needed for a specific optimized design, but this simple example shows that the heat exchange capability of such a device is not at all trivial. Depending upon the heat extraction requirements of a specific application, or class of applications, the parameters of the device such as dimensions, specific choice of materials, number and thickness of the radiating fins, etc. can be readily defined. Thus, the appropriate area and surface characteristics of any particular cooling apparatus as described herein can be readily determined and the appropriate apparatus designed for any particular application by a competent engineer given the description of the apparatus contained herein.

As will be apparent to the skilled artisan, although heat sink 12 is depicted and described herein in terms of a coolant conduit, other suitable means can be used as the heat sink. For example, a finned aluminum heat extractor could be substituted for coolant conduit 12 in an appropriate situation.

As the invention has been described, it will be apparent to those skilled in the art that the same may be varied in many ways without departing from the spirit and scope of the invention. Any and all such modifications are intended to be included within the scope of the appended claims.

What is claimed is:

1. A heat exchange apparatus comprising:

A) a heat sink having a first radial array of spaced-apart parallel plate fins or needles extending from its surface;

B) a body to be cooled; and

C) a second radial array of spaced-apart parallel plate fins or needles thermally coupled to said body to be cooled said first and said second radial arrays of spaced-apart parallel plate or needles meshing without contact to permit the transfer of heat therebetween by radiation, and wherein said heat sink comprises a cylindrical conduit, said first radial array of spaced-apart parallel plate fins or needles are disposed about the periphery of said cylinder, said body to be cooled is thermally coupled to said second radial array of spaced-apart parallel plate fins or needles via a cylindrical retainer about said cylindrical conduit.

2. The heat exchange apparatus of claim 1 wherein said body to be cooled said retainer and said second radial array of spaced-apart parallel plate fins or needles rotate about said cylindrical conduit and said first radial array of spaced-apart parallel plate fins or needles.

3. A heat exchange apparatus comprising:

A) a heat sink having a first radial array of spaced-apart parallel plate fins or needles extending from its surface;

B) a body to be cooled; and

C) a second radial array of spaced-apart parallel plate fins or needles thermally coupled to said body to be cooled said first and said second radial arrays of spaced-apart parallel plate or needles meshing without contact to permit the transfer of heat therebetween by radiation, and wherein said heat sink comprises a cylindrical conduit, said first radial array of spaced-apart parallel plate fins or needles are disposed about the periphery of said cylinder, said body to be cooled is cylindrical and thermally coupled to said second radial array of spaced-apart parallel plate fins or needles.

* * * * *